US011517080B2

(12) United States Patent
Lei

(10) Patent No.: US 11,517,080 B2
(45) Date of Patent: Dec. 6, 2022

(54) FREELY SPLICED BUCKLE STRAP AND WATCHBAND

(71) Applicant: Yang Lei, Sichuan (CN)

(72) Inventor: Yang Lei, Sichuan (CN)

(73) Assignee: Yang Lei, Dazhou (CN)

( * ) Notice: Subject to any disclaimer, the term of this patent is extended or adjusted under 35 U.S.C. 154(b) by 0 days.

(21) Appl. No.: 17/169,532

(22) Filed: Feb. 7, 2021

(65) Prior Publication Data

US 2022/0248812 A1 Aug. 11, 2022

(51) Int. Cl.
*A44C 5/14* (2006.01)
*A44C 5/20* (2006.01)

(52) U.S. Cl.
CPC ..... *A44C 5/14* (2013.01); *A44C 5/2019* (2013.01); *A44D 2203/00* (2013.01)

(58) Field of Classification Search
CPC ..... A44C 5/14; A44C 5/2019; A44D 2203/00
See application file for complete search history.

(56) References Cited

U.S. PATENT DOCUMENTS 2,615,227 A * 10/1952 Hornik ..... A44C 5/2071 24/303
2,648,884 A * 8/1953 Loofboro ..... A44C 5/2071 24/303
3,293,714 A * 12/1966 Shafer ..... A44B 11/2596 24/303
6,292,985 B1 * 9/2001 Grunberger ..... A44B 11/2592 24/303
6,857,169 B2 * 2/2005 Chung ..... A44B 11/258 24/303
8,359,716 B2 * 1/2013 Fiedler ..... A44B 11/25 24/303
8,464,403 B2 * 6/2013 Fiedler ..... H01F 7/0263 24/303
8,794,682 B2 * 8/2014 Fiedler ..... E05B 15/04 292/251.5
10,098,422 B2 * 10/2018 Fiedler ..... A44C 5/0007
2003/0229974 A1 * 12/2003 Zemer ..... A44C 5/2076 24/303
2008/0124008 A1 * 5/2008 Meager ..... A44B 19/267 383/63
2012/0044031 A1 * 2/2012 Ninomiya ..... A44B 11/2596 335/219
2014/0277103 A1 * 9/2014 Esposito ..... A44B 11/258 606/203
2016/0270491 A1 * 9/2016 Spencer ..... A44C 5/2085

* cited by examiner

*Primary Examiner* — Robert Sandy
*Assistant Examiner* — Louis A Mercado
(74) *Attorney, Agent, or Firm* — Nitin Kaushik

(57) ABSTRACT

The disclosure concerns a freely spliced buckle strap, at least two buckle units and a buckle connection structure; the buckle connection structure includes a clamping protrusion and a clamping groove, and a first transverse convex strip is provided on or closed to the clamping protrusion; the clamping groove is provided with a second transverse convex strip that can be matched, clamped and locked with the first transverse convex strip; two adjacent buckle units are placed in the clamping groove of the other buckle unit, and are reliably connected to form a whole through the match, clamping and locking by the first and second transverse convex strips.

8 Claims, 4 Drawing Sheets

FREELY SPLICED BUCKLE STRAP AND WATCHBAND

BACKGROUND OF THE INVENTION

1. Field of the Invention

The invention relates to the field of strap bodies, in particular to a freely spliced buckle strap and watchband.

2. Description of the Related Art

With the development of business and the improvement of people's lives, the watch is no longer a mere timekeeping tool for marking the moment. Especially in modern society, people have higher and higher requirements for the appearance of watches and straps. In particular, they hope that the straps can be easily disassembled and adjusted on the basis of beautiful appearance and fashionable novelty. At present, the watchbands on the market cannot meet the fashionable and novel appearance requirements, and a special small screwdriver must be used to realize the length of the strap adjustment. The operation is extremely inconvenient, so it cannot meet the requirements of consumers.

SUMMARY OF THE INVENTION

The purpose of the invention is to address the above problems and shortcomings, and to provide a freely spliced buckle strap and watchband with different buckle sections according to the user's requirements on the shape and length of use, and is extremely simple and convenient to disassemble and assemble without special tools, simple in structure, and wide in use.

The technical solution of the invention is realized as follows:

the freely spliced buckle strap of the invention comprises at least two buckle units and a buckle connection structure provided on the two buckle units, wherein the buckle connection structure comprises a clamping protrusion provided at one connecting end of one buckle unit and a clamping groove provided at one connecting end of the other buckle unit, and a first transverse convex strip is provided on or closed to the clamping protrusion; the clamping groove is provided with a second transverse convex strip that can be matched, clamped and locked with the first transverse convex strip; two adjacent buckle units are placed in the clamping groove of the other buckle unit through the clamping protrusion of one buckle unit, and are reliably connected to form a whole through the match, clamping and locking by the first transverse convex strip and the second transverse convex strip. The outer surfaces of the first transverse convex strip and the second transverse convex strip are arc transition surfaces.

Further, the clamping protrusion comprises a long protrusion and a short protrusion arranged transversely; the clamping groove comprises a long groove and a short groove that can be matched and sleeved with the long protrusion and the short protrusion; the long protrusion can be used to restrict left and right and up and down movement, and the short protrusion can be used to block to prevent forward and backward movement.

In order to make the overall appearance more beautiful after splicing, the connecting ends of two adjacent buckle belt units are made into a stepped structure that can match with butt; the clamping protrusion and the clamping groove are respectively arranged on the stepped structure of the corresponding buckle unit, which enables that when two adjacent strap units are connected as a whole, the surface can be in smooth butt or smooth transition butt.

The first transverse convex strip comprises a first inner clamping strip arranged on the inner side of the clamping protrusion, and the second transverse convex strip comprises a second inner clamping strip correspondingly arranged on the inner side of the clamping groove; after two adjacent buckle units are placed in the clamping groove of the other buckle unit through the clamping protrusion of one buckle unit, and then are reliably connected to form a whole through the match, clamping and locking by the first inner clamping strip and the second inner clamping strip. In order to make the buckle structure more reliable, the first transverse convex strip further comprises a third inner clamping strip arranged on the end surface of the connecting end of the buckle unit close to the clamping protrusion, and the second transverse convex strip further comprises a fourth inner clamping strip correspondingly arranged on the other side of the clamping groove.

The invention generally comprises at least three buckle units that can be connected to form a whole, in which the other connecting ends of two buckle units are provided with a corresponding connecting head that can be connected with other objects; one connecting end of the remaining buckle units is provided with the clamping protrusion and the first transverse convex strip, and the other connecting end is provided with the clamping groove and the second transverse convex strip. The other objects include a watch head, a belt head, a strap head or a strap body.

The length of each buckle unit can be the same or different. The buckle connection structure and the buckle unit are integrally formed, or the buckle connection structure is embedded in the end of the buckle unit.

The invention further relates to a watchband, wherein the watchband is formed by connecting a plurality of buckle units according to claim 1; two adjacent buckle units are placed in the clamping groove of the other buckle unit through the clamping protrusion of one buckle unit, and are reliably connected to form a whole through the match, clamping and locking by the first transverse convex strip and the second transverse convex strip.

The advantages of the invention compared with the prior art are:

1. the length of the buckle strap can be freely matched with different buckle strap units (also called buckle strap section) according to the actual length of use, that is, the length of the strap can be adjusted freely, which is very user-friendly and conforms to the modern society's pursuit of fashion and practicality.

2. The buckle structure composed of the clamping protrusion, the clamping groove and the transverse convex strip is not only extremely simple and convenient for disassembly and assembly without special tools, but also simple in structure.

3. It can be widely used in watchbands, backpack straps, belts and other items, especially for watchbands.

The invention will be further explained hereinafter with reference to the drawings.

DETAILED DESCRIPTION OF THE PREFERRED EMBODIMENTS

Figure 1:
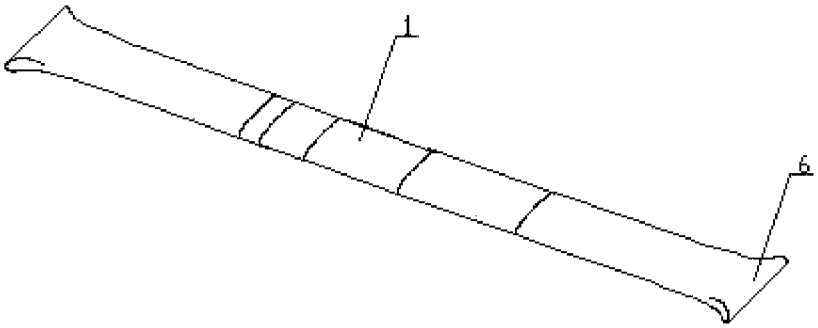
FIG. 1 is a schematic diagram of the structural of Embodiment 1 of the invention.
Figure 2:
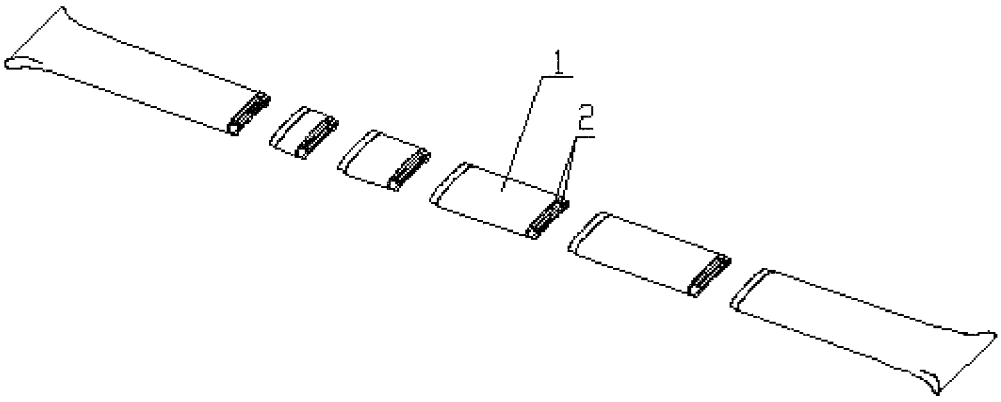
FIG. 2-FIG. 3 are schematic diagrams of the assembly structure of FIG. 1.
Figure 3:
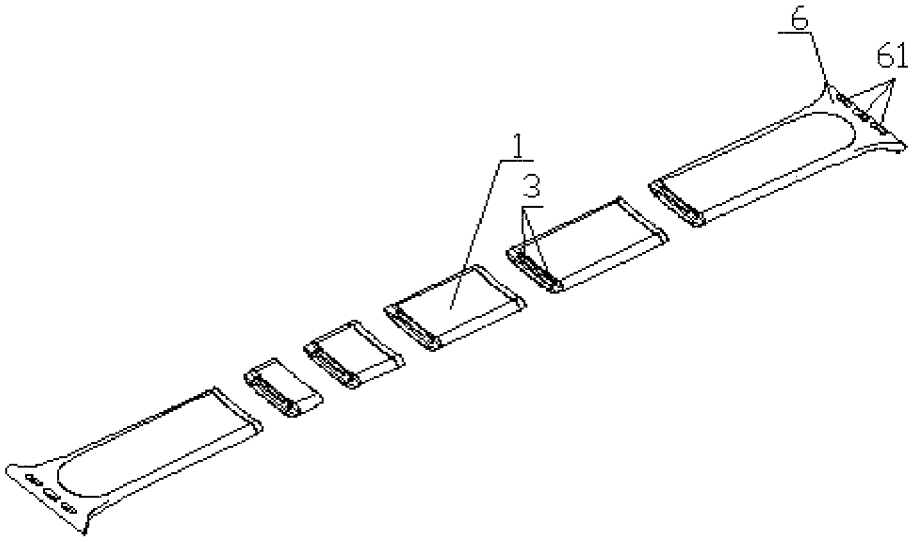
Figure 4:
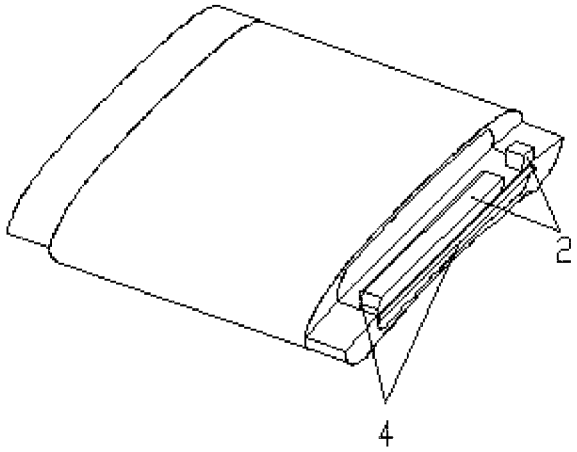
FIG. 4-FIG. 6 are enlarged schematic diagrams of the structure of the buckle unit with different lengths in the invention.
Figure 5:
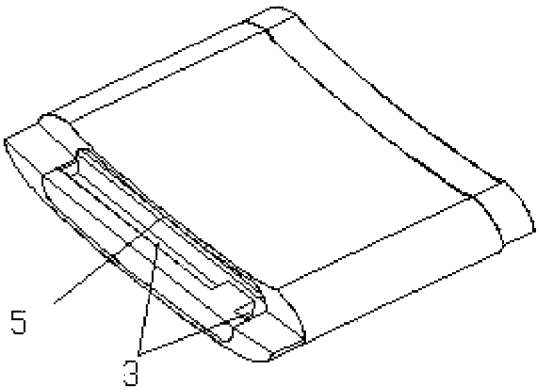
Figure 6:
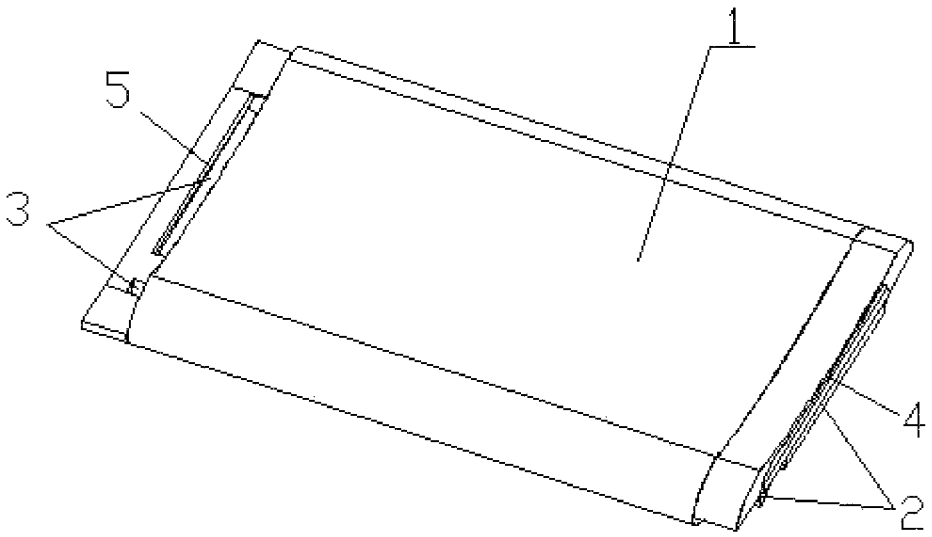
Figure 7:
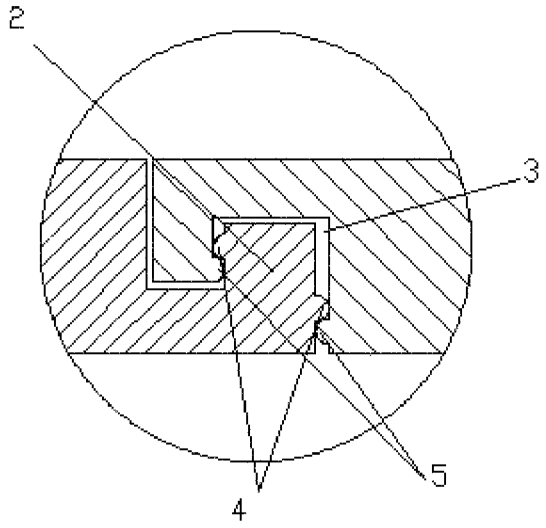
FIG. 7 is an enlarged schematic diagram of the cross-sectional structure of a buckle structure of the invention.

As shown in FIG. 1-9, the freely spliced buckle strap of the invention comprises at least two buckle units 1 and a buckle connection structure provided on the two buckle units 1, wherein the buckle connection structure comprises a clamping protrusion 2 provided at one connecting end of one buckle unit 1 and a clamping groove 3 provided at one connecting end of the other buckle unit 1, and a first transverse convex strip 4 is provided on or closed to the clamping protrusion 2; the clamping groove 3 is provided with a second transverse convex strip 5 that can be matched, clamped and locked with the first transverse convex strip 4; two adjacent buckle units 1 are placed in the clamping groove 3 of the other buckle unit through the clamping protrusion 2 of one buckle unit, and are reliably connected to form a whole through the match, clamping and locking by the first transverse convex strip 4 and the second transverse convex strip 5. When splicing, the clamping protrusion can be well fitted in the clamping groove by simple pressing. When the two buckle units 1 need to be disassembled, they only need to be opened directly without additional tools, so the disassembly and assembly are extremely convenient. The length of each buckle unit 1 can be the same or different. The buckle connection structure and the buckle unit 1 are integrally formed, or the buckle connection structure is embedded in the end of the buckle unit 1.

In order to make the connection structure of the two buckle units 1 more reliable, the clamping protrusion 2 comprises a long protrusion and a short protrusion arranged transversely; the clamping groove 3 comprises a long groove and a short groove that can be matched and sleeved with the long protrusion and the short protrusion; the long protrusion can be used to restrict left and right and up and down movement, and the short protrusion can be used to block to prevent forward and backward movement. In order to make the overall appearance more beautiful after splicing, the connecting ends of two adjacent buckle belt units 1 are made into a stepped structure that can match with butt; the clamping protrusion 2 and the clamping groove 3 are respectively arranged on the stepped structure of the corresponding buckle unit 1, which enables that when two adjacent strap units are connected as a whole, the surface can be in smooth butt or smooth transition butt. In order to make splicing more convenient and labor-saving, the outer surfaces of the first transverse convex strip 4 and the second transverse convex strip 5 are arc transition surfaces. The first transverse convex strip 4 comprises a first inner clamping strip arranged on the inner side of the clamping protrusion 2, and the second transverse convex strip 5 comprises a second inner clamping strip correspondingly arranged on the inner side of the clamping groove 3; after two adjacent buckle units are placed in the clamping groove 3 of the other buckle unit 1 through the clamping protrusion 2 of one buckle unit 1, and then are reliably connected to form a whole through the match, clamping and locking by the first inner clamping strip and the second inner clamping strip. In order to further strengthen the connection reliability of the buckle structure, the first transverse convex strip 4 further comprises a third inner clamping strip arranged on the end surface of the connecting end of the buckle unit 1 close to the clamping protrusion 2, and the second transverse convex strip 5 further comprises a fourth inner clamping strip correspondingly arranged on the other side of the clamping groove 3. In this way, it can be locked by double locking, so the connection structure is more reliable.

The invention generally comprises at least three buckle units 1 that can be connected to form a whole, in which the other connecting ends of two buckle units are provided with a corresponding connecting head 6 that can be connected with other objects; one connecting end of the remaining buckle units 1 is provided with the clamping protrusion 2 and the first transverse convex strip 4, and the other connecting end is provided with the clamping groove 3 and the second transverse convex strip 5. The invention has a wide application range and can be widely applied to watchbands, backpack belts, belts and other articles, and is especially suitable for watchbands. Therefore, the other objects include a watch head, a belt head, a strap head or a strap body. The structure of the connector can be appropriately changed according to the purpose, such as a watchband connector, a belt connector, a backpack strap connector, etc. When the invention is used on a watchband, the connecting head 6 is provided with a dial clamping buckle 61. The invention can further be used for splicing toys.

Figure 8:
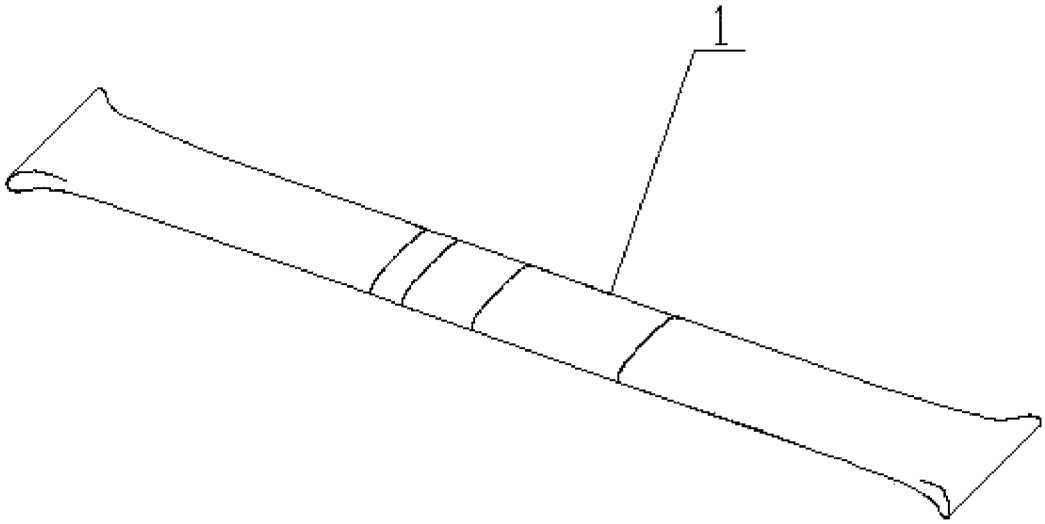
FIG. 8-FIG. 9 are schematic structural diagrams of two other embodiments of the invention.
Figure 9:
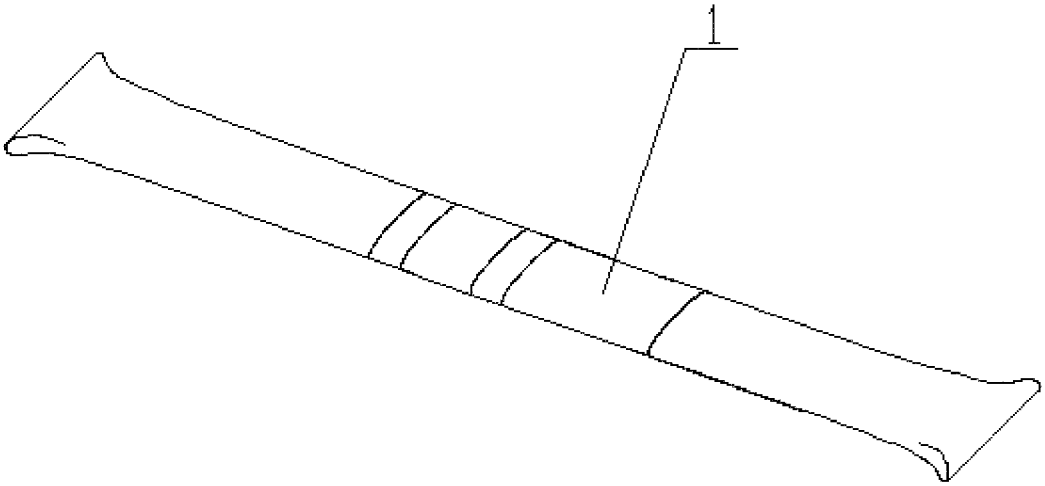

The invention further relates to a watchband. The watchband is formed by connecting a plurality of buckle units 1 according to claim 1; two adjacent buckle units 1 are placed in the clamping groove 3 of the other buckle unit through the clamping protrusion 2 of one buckle unit, and are reliably connected to form a whole through the match, clamping and locking by the first transverse convex strip 4 and the second transverse convex strip 5. The specific structures of the clamping protrusion, the clamping groove, and the first transverse convex strip 4 and the second transverse convex strip 5 have been described hereinabove and will not be repeated here. The connecting head 6 of the buckle unit at both ends of the watchband is provided with a dial clamping buckle 61. FIGS. 1 and 9 show a watchband formed by splicing six buckle units, and the buckle units are different in lengths, and the appearance is novel and fashionable. FIG. 8 shows a watchband formed by splicing 5 buckle units.

Although the invention is described with reference to specific embodiments, this description is not meant to limit the invention. With reference to the description of the invention, other modifications in the disclosed embodiments are foreseeable by those skilled in the art, and such modifications shall fall within the scope defined by the appended claims.

What is claimed is:

1. A freely spliced buckle strap, comprising at least two buckle units (1) and a buckle connection structure provided on the two buckle units (1), wherein the buckle connection structure comprises a clamping protrusion (2) provided at one connecting end of one buckle unit (1) and a clamping groove (3) provided at one connecting end of the other buckle unit (1), and a first transverse convex strip (4) is provided on or closed to the clamping protrusion (2); the clamping groove (3) is provided with a second transverse convex strip (5) that can be matched, clamped and locked with the first transverse convex strip (4); two adjacent of the buckle units (1) are placed in the clamping groove (3) of the other buckle unit through the clamping protrusion (2) of the one buckle unit, and are reliably connected to form a whole through a match, clamping and locking by the first transverse convex strip (4) and the second transverse convex strip (5);

wherein the clamping protrusion (2) comprises a long protrusion and a short protrusion arranged transversely; the clamping groove (3) comprises a long groove and a short groove that can be matched and sleeved with the long protrusion and the short protrusion; the long protrusion can be used to restrict left and right and up and down movement, and the short protrusion can be used to block to prevent forward and backward movement.

2. The freely spliced buckle strap according to claim 1, wherein the connecting ends of the two buckle units (1) are made into a stepped structure that can match with butt; the clamping protrusion (2) and the clamping groove (3) are respectively arranged on the stepped structure of the corresponding buckle unit (1), which enables that when two adjacent strap units are connected as a whole, a surface can be in smooth butt or smooth transition butt.

3. The freely spliced buckle strap according to claim 1, wherein outer surfaces of the first transverse convex strip (4) and the second transverse convex strip (5) are arc transition surfaces.

4. The freely spliced buckle strap according to claim 1, wherein the first transverse convex strip (4) comprises a first inner clamping strip arranged on an inner side of the clamping protrusion (2), and the second transverse convex strip (5) comprises a second inner clamping strip correspondingly arranged on an inner side of the clamping groove (3); after the two buckle units are placed in the clamping groove (3) of the other buckle unit (1) through the clamping protrusion (2) of the one buckle unit (1), and then are reliably connected to form the whole through the match, clamping and locking by the first inner clamping strip and the second inner clamping strip.

5. The freely spliced buckle strap according to claim 4, wherein the first transverse convex strip (4) further comprises a third inner clamping strip arranged on an end surface of the one connecting end of the one buckle unit (1) close to the clamping protrusion (2), and the second transverse convex strip (5) further comprises a fourth inner clamping strip correspondingly arranged on the other side of the clamping groove (3).

6. The freely spliced buckle strap according to claim 1, wherein it comprises at least three of buckle units (1) that can be connected to form the whole, in which the other connecting ends of the two buckle units are provided with a corresponding connecting head (6) that can be connected with other objects; the one connecting end of the remaining buckle units (1) is provided with the clamping protrusion (2) and the first transverse convex strip (4), and the other connecting end is provided with the clamping groove (3) and the second transverse convex strip (5).

7. The freely spliced buckle strap according to claim 6, wherein the other objects include a watch head, a belt head, a strap head or a strap body; a length of each of the buckle unit (1) is a same or different.

8. The freely spliced buckle strap according to claim 1, wherein the buckle connection structure and the buckle unit (1) are integrally formed, or the buckle connection structure is embedded in the connecting end of the buckle unit (1).

* * * * *